US009702590B2

(12) United States Patent
Wen et al.

(10) Patent No.: US 9,702,590 B2
(45) Date of Patent: Jul. 11, 2017

(54) METHOD FOR OPERATING A WATER HEATER APPLIANCE

(71) Applicant: General Electric Company, Schenectady, NY (US)

(72) Inventors: Yicheng Wen, Louisville, KY (US); William Jerome Burke, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 1076 days.

(21) Appl. No.: 13/761,635

(22) Filed: Feb. 7, 2013

(65) Prior Publication Data

US 2014/0217187 A1 Aug. 7, 2014

(51) Int. Cl.
*F24H 9/20* (2006.01)

(52) U.S. Cl.
CPC ..... *F24H 9/2007* (2013.01); *F24H 9/2021* (2013.01); *F24H 9/2035* (2013.01)

(58) Field of Classification Search
CPC ..... F24H 9/2007; F24H 9/2021; F24H 9/2035
See application file for complete search history.

(56) References Cited

U.S. PATENT DOCUMENTS 5,822,997 A * 10/1998 Atterbury ..... F25B 13/00 165/239
2009/0120380 A1* 5/2009 Chian ..... G05D 23/1904 122/14.1
2012/0118989 A1* 5/2012 Buescher ..... F24H 9/2021 237/8 A
2013/0051777 A1* 2/2013 Brian ..... F24H 1/20 392/464
2014/0217188 A1* 8/2014 Wen ..... F24H 9/2007 236/25 R

FOREIGN PATENT DOCUMENTS

EP 0356609 A1 3/1990

* cited by examiner

*Primary Examiner* — Ljiljana Ciric
*Assistant Examiner* — Alexis Cox
(74) *Attorney, Agent, or Firm* — Dority & Manning, P.A.

(57) ABSTRACT

A method for operating a water heater appliance includes obtaining a plurality of water temperature measurements over a period of time, determining at least one heated water draw event for the water heater appliance, and establishing a future operating schedule for the water heater appliance. The water heater appliance is operated according to the future operating schedule.

17 Claims, 6 Drawing Sheets

(a) Weekdays with $\alpha = 0.05$ (a) Weekdays with $\alpha = 0.05$

METHOD FOR OPERATING A WATER HEATER APPLIANCE

FIELD OF THE INVENTION

The present subject matter relates generally to water heater appliances and methods for operating the same.

BACKGROUND OF THE INVENTION

Certain water heater appliances operate such that water with the water heater's tank is maintained at a predetermined temperature. Generally, a user can select the predetermined temperature using a dial or other input on the water heater. Such water heater appliances generally heat water located with the water heater's tank at the predetermined temperature until the predetermined temperature is changed or the water heater appliance is deactivated. However, heated water from a water heater appliance is generally unneeded during certain portions of the day, such as when occupants of an associated building are regularly absent. Thus, despite no demand or limited demand for heated water, the water heater appliance can continue to operate and heat water located within the water heater's tank. Such operations can waste valuable energy.

Accordingly, methods for predicting time periods of limited heated water demand would be useful. In particular, methods for predicting time periods of limited heated water demand and adjusting a set temperature of the water heater appliance based upon such time periods would be useful.

BRIEF DESCRIPTION OF THE INVENTION

The present subject matter provides a method for operating a water heater appliance. The method includes obtaining a plurality of water temperature measurements over a period of time, determining at least one heated water draw event for the water heater appliance, and establishing a future operating schedule for the water heater appliance. The method can assist with improving energy efficiency of the water heater appliance by reducing a set temperature of the water heater appliance during time periods of limited heated water demand. Additional aspects and advantages of the invention will be set forth in part in the following description, or may be apparent from the description, or may be learned through practice of the invention.

In a first exemplary embodiment, a method for operating a water heater appliance is provided. The method includes obtaining a plurality of water temperature measurements for water within the water heater appliance over a period of time, determining at least one heated water draw event for the water heater appliance based at least in part upon the plurality of water temperature measurements, and establishing a future operating schedule for the water heater appliance based at least in part upon the at least one heated water draw event.

In a second exemplary embodiment, a method for operating a water heater appliance is provided. The method includes obtaining a plurality of water temperature measurements, $T_k$, for water within the water heater appliance at time k, determining a high volume heated water event for the water heater appliance by comparing a slope between at least two water temperature measurements of $T_k$ to a predetermined slope, and establishing a future operating schedule for the water heater appliance. The future operating schedule includes a time period during which the water heater appliance operates at a higher set temperature, $T_{high}$, and a time period during which the water heater appliance operates at a lower set temperature, $T_{low}$. The time period during which the water heater appliance operates at $T_{high}$ corresponds to the high volume heated water event.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
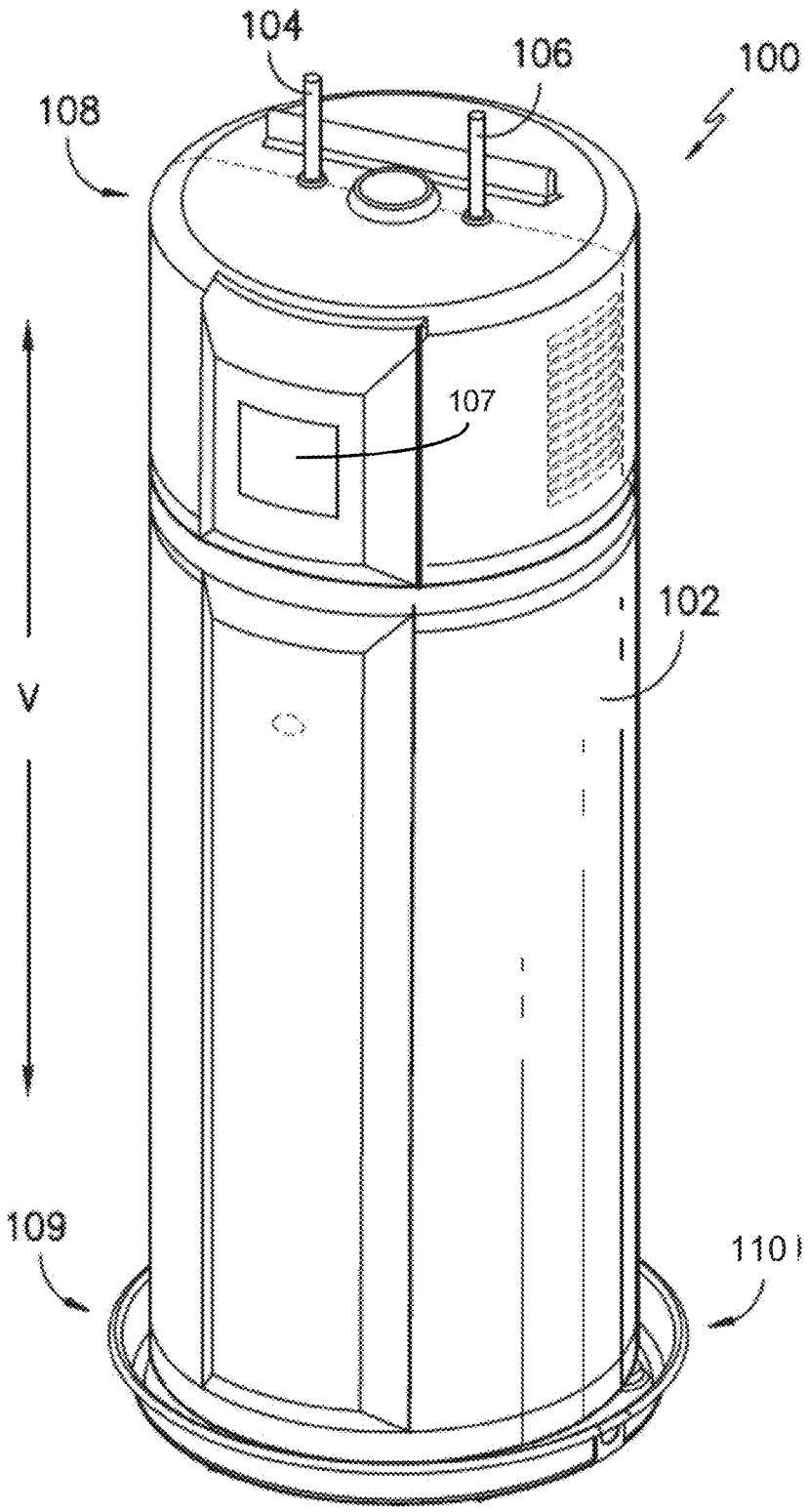
FIG. 1 provides a perspective view of an exemplary water heater appliance as may be used with the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of an exemplary water heater appliance 100 suitable for use with the present subject matter. Water heater appliance 100 includes a casing 102. A tank (not shown) and a heating element 105 (FIG. 2) are mounted within casing 102 for heating water therein. Heating element 105 may be a gas burner, an electric resistance element, a microwave element, an induction element, or any other suitable heating element or combination thereof. In alternative exemplary embodiments, water heater appliance 100 may include any suitable number of additional heating elements, e.g., one, two, three, or more additional heating elements.

Water heater appliance 100 also includes a cold water conduit 104 and a hot water conduit 106 that are both in fluid communication with the tank within casing 102. As an example, cold water from a water source, e.g., a municipal water supply or a well, can enter water heater appliance 100 through cold water conduit 104. From cold water conduit 104, such cold water can enter the tank wherein it is heated with heating element 105 to generate heated water. Such heated water can exit water heater appliance 100 at hot water conduit 106 and, e.g., be supplied to a bath, shower, sink, or any other suitable feature.

Water heater appliance 100 extends longitudinally between a top portion 108 and a bottom portion 109 along a vertical direction V. Thus, water heater appliance 100 is generally vertically oriented. Water heater appliance 100 can be leveled, e.g., such that casing 102 is plumb in the vertical direction V, in order to facilitate proper operation of water heater appliance 100.

A drain pan 110 is positioned at bottom portion 109 of water heater appliance 100 such that water heater appliance 100 sits on drain pan 110. Drain pan 110 sits beneath water heater appliance 100 along the vertical direction V, e.g., to collect water that leaks from water heater appliance 100 or water that condenses on an evaporator (not shown) of water heater appliance 100. It should be understood that water heater appliance 100 is provided by way of example only and that the present subject matter may be used with any suitable water heater appliance.

As will be understood by those skilled in the art, heating element 105 (FIG. 2) operates to heat and maintain water with water heater appliance 100 at a selected operating temperature, e.g., between about one-hundred degrees Fahrenheit and about one-hundred and forty degrees Fahrenheit. However, continuous operation of water heater appliance 100 at the selected operating temperature can be wasteful or inefficient due to limited demand for heater water from water heater appliance 100 during particular time periods, e.g., when a user of water heater appliance 100 is at work or sleeping. In particular, operating water heater appliance 100 in order to maintain the large volume of water within water heater appliance 100 at the selected operating temperature can be expensive and energy intensive relative to the demand for heated water.

The present subject matter permits or assists water heater appliance 100 with operating at various operating temperatures, e.g., depending upon a predicted demand for heated water. For example, the present subject matter can permit or assist the water heater appliance 100 with establishing a schedule of operating temperatures that includes lower set temperature time periods corresponding to periods of lower heated water demand and higher set temperature time periods corresponding to periods of higher heated water demand. Thus, water heater appliance 100 can shift between a higher set temperature, e.g., between about one-hundred degrees and about one-hundred and forty degrees Fahrenheit, and a lower set temperature depending upon a predicted demand for heated water. The lower set temperature can be any suitable temperature. For example, the lower set temperature can be between about forty degrees Fahrenheit and about sixty degrees Fahrenheit, between about forty-five degrees and about fifty-five degrees Fahrenheit, or between about forty degrees Fahrenheit and about eighty degrees Fahrenheit. By shifting the operating temperature of water heater appliance 100 between the high and low set temperatures, a cost of operating water heater appliance 100 can be reduced and an efficiency of water heater appliance 100 can be improved as well, e.g., because operating water heater appliance 100 at the lower set temperature can be cheaper or more efficient relative to operating water heater appliance 100 at the higher set temperature.

Water heater appliance 100 can shift between the higher and lower set temperatures by adjusting a power output of heating element 105. Any suitable method or mechanism can be used to adjust the power output of heating element 105. For example, a duty cycle of heating element 105 can be reduced or increased. Alternatively, a TRIAC control can be utilized to adjust the power output of heating element 105.

Figure 2:
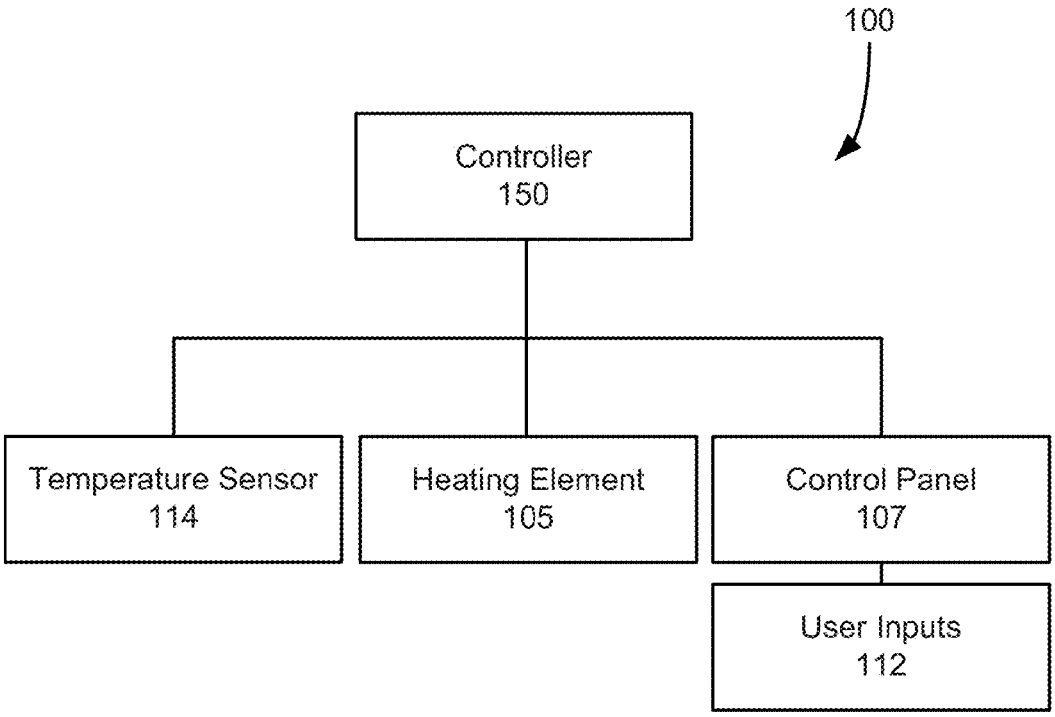
FIG. 2 provides a schematic view of certain components of the water heater appliance of FIG. 1.

FIG. 2 provides a schematic view of certain components of water heater appliance 100. As may be seen in FIG. 2, water heater appliance 100 includes heating element 105, user inputs 112, a temperature sensor 114, and a controller 150. As discussed above heating element 105 is positioned within water heater appliance 100 and configured for heating water therein. User inputs 112 permit a user to operate controller 150 and/or water heater appliance 100. User inputs 112 include a control panel 107 mounted to water heater appliance 100. Control panel 107 may be any type of interface such as a touch screen, knobs, sliders, buttons, speech recognition, etc., mounted to water heater appliance 100 that permits a user to input control commands for water heater appliance 100 and/or controller 150.

Temperature sensor 114 is configured for measuring a temperature of water within the tank of water heater appliance 100. Temperature sensor 114 may be any suitable device for measuring the temperature of water. For example, temperature sensor 114 can be a thermistor or a thermocouple. Controller 150 can receive a signal, such as a voltage or a current, from temperature sensor 114 that corresponds to the temperature of water within the tank of water heater appliance 100. In such a manner, the temperature of water within the tank of water heater appliance 100 can be monitored and/or recorded with controller 150.

Controller 150 is in, e.g., operative, communication with user inputs 112, temperature sensor 114, and heating element 105. Thus, controller 150 can selectively activate heating element 105 based upon signals from user inputs 112 and/or temperature sensor 114. Controller 150 includes memory and one or more processing devices such as microprocessors, CPUs or the like, such as general or special purpose microprocessors operable to execute programming instructions or micro-control code associated with operation of water heater appliance 100. The memory can represent random access memory such as DRAM, or read only memory such as ROM or FLASH. The processor executes programming instructions stored in the memory. The memory can be a separate component from the processor or can be included onboard within the processor. Alternatively, controller 150 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 150 may be position at a variety of locations. In the exemplary embodiment shown in FIG. 1, controller 150 is positioned within water heater appliance 100, e.g., as an integral component of water heater appliance 100. In alternative exemplary embodiments, controller 150 may positioned away from water heater appliance 100 and communicates with water heater appliance 100 over a wireless connection or any other suitable connection, such as a wired connection.

Controller 150 can include a time keeping mechanism (not shown) that provides information to controller 150 and/or a user regarding the current time of the day. The time keeping mechanism also includes a calendar function to provide information regarding the day of the week and the current date. A user can set the time keeping mechanism manually, or the time keeping mechanism can set automatically, e.g., via synchronization to an atomic clock radio signal.

Figure 3:
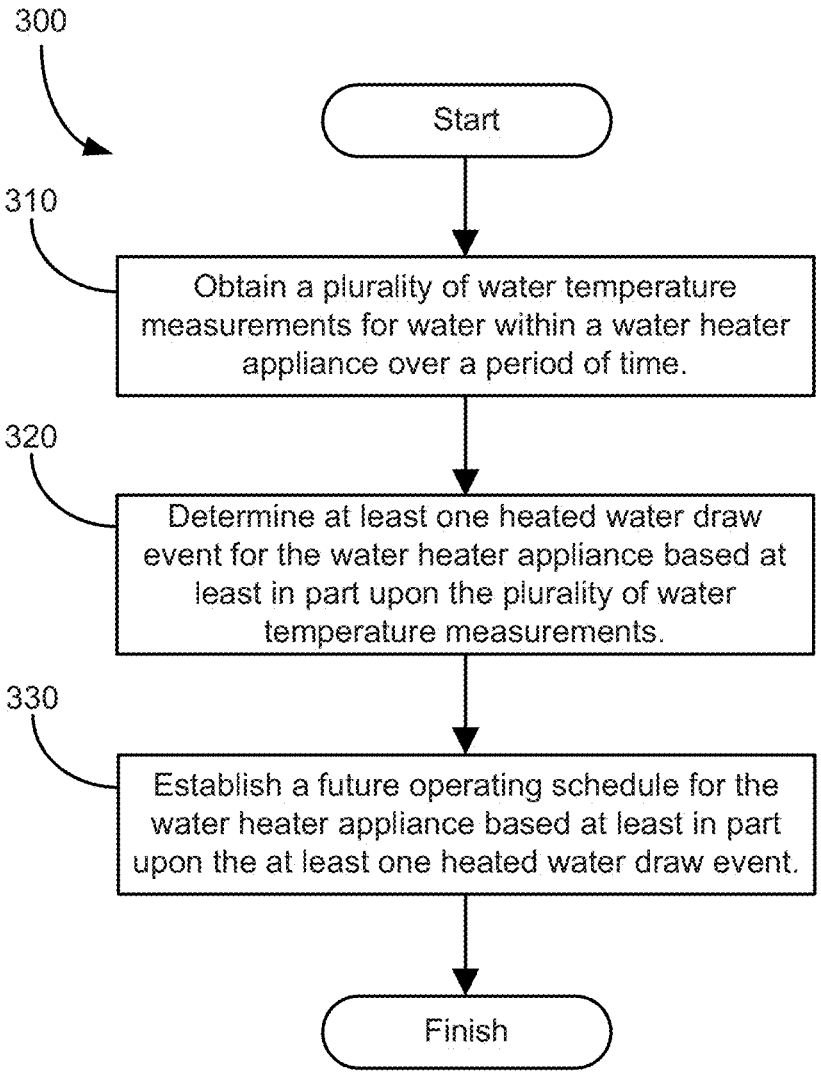
FIG. 3 provides a method for operating a water heater appliance according to an exemplary embodiment of the present subject matter.

FIG. 3 provides a method 300 for operating a water heater appliance, such as water heater appliance 100, according to an exemplary embodiment of the present subject matter. Method 300 can be implemented by controller 150 of water heater appliance 100. Method 300 can permit water heater appliance 100 to operate efficiently and in a cost effective manner as discussed in greater detail below.

At step 310, controller 150 obtains a plurality of water temperature measurements from temperature sensor 114. Water temperature measurements from temperature sensor 114 correspond to a temperature of water within water heater appliance 100. Controller 150 obtains the plurality of water temperature measurements over a period of time, e.g., about twenty-four hours, about a week, or about a month, during step 310.

At step 320, controller 150 determines at least one heated water draw event for water heater appliance 100 based at least in part upon the plurality of water temperature measurements from step 310. Each heated water draw event of the at least one heated water draw event corresponds to a period during which a relatively large volume of heated water is removed from water heater appliance 100. As an example, a heated water draw event can correspond to a user taking a shower or drawing a bath, using a dishwasher appliance or a washing machine appliance, or any other event in which a relatively large volume of heated water is drawn from water heater appliance 100.

Figure 5:
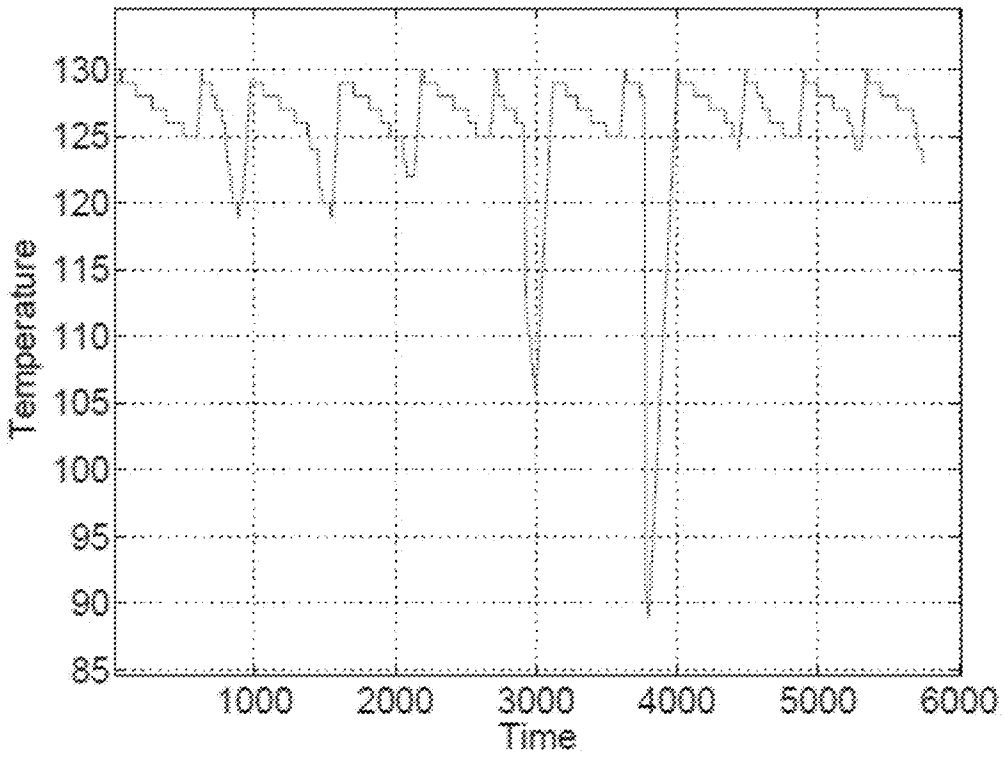
FIG. 5 illustrates an exemplary plot of temperature measurements for water within a water heater appliance over time as may be obtained with the present subject matter.

Controller 150 can determine the at least one heated water draw event for water heater appliance 100 by comparing a slope between at least two of the plurality of water temperature measurements from step 310 to a predetermined slope. In particular, each heated water draw event of the at least one heated water draw event can correspond to a portion of the period of time that temperature measurements are obtained during step 310 during which a magnitude of the slope between the at least two water temperature measurements is greater than a magnitude of the predetermined slope. As an example, FIG. 5 illustrates an exemplary plot of temperature measurements for water within water heater appliance 100 obtained from temperature sensor 114 over time. As may be seen in FIG. 5, the temperature of water within water heater appliance 100 drops quickly at certain times. Such temperature drops correspond to heated water draw events. Because large volumes of heated water are drawn from water heater appliance 100 during such events, the temperature of water within water heater appliance 100 drops, e.g., as relatively cooler water enters water heater appliance 100 to replace the drawn out warmer water.

At step 320, controller 150 can determine the at least one heated water draw event for water heater appliance 100 with the following:

$$W = \left\{ n: \sum_{j=1}^{K} h_j(n) \geq \alpha K \right\}$$

-continued where $W$ is a set of samples $n$, $$h_j(n) = \begin{cases} 1 & \sum_{i=(n-1)N+1}^{nN} H_j(i) \geq N/2 \\ 0 & \text{otherwise} \end{cases},$$

$h_j(n)$ is a sampled heated water draw event value at sample n on day j,

N is a number of minutes between samples, $H_j(i)$ is a heated water draw event value at time i on day j that is one during heated water draw events and zero otherwise, K is a number of days, and $\alpha$ is a confidence factor.

Figure 6:
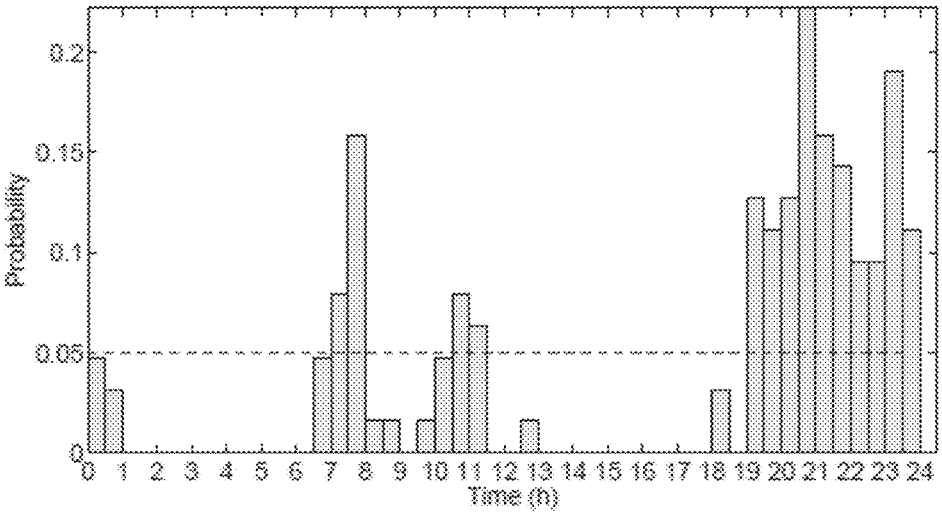
FIG. 6 illustrates an exemplary histogram of heated water draw events for a water heater appliance as may be obtained with the present subject matter.

Utilizing the above process, heated water draw events for water heater appliance 100 may be obtained at step 320. As an example, FIG. 6 illustrates an exemplary histogram of heated water draw events for water heater appliance 100. As may be seen in FIG. 6, if the magnitude of the slope between the at least two water temperature measurements is greater than the magnitude of the predetermined slope with a certain frequency or regularity, controller 150 can determine that a heated water draw event for water heater appliance 100 occurs at such time. Thus, the above process can capture or identify a habit of a user of water heater appliance 100 over a period of time, e.g., a week, by examining periodic temperature measurements taken, e.g., daily, during the period of time. It should be understood that the at least one heated water draw event can be determined using any other suitable mechanism or process in alternative exemplary embodiments. Thus, the process provided above is provided by way of example only and is not intended to limit the present subject matter in any aspect.

At step 330, controller 150 establishes a future operating schedule for water heater appliance 100 based at least in part upon the at least one heated water draw event. The future operating schedule can include at least one higher set temperature operating period during which water heater appliance 100 operates at a higher set temperature and at least one lower set temperature operating period during which water heater appliance 100 operates at a lower set temperature. Each higher set temperature operating period of the at least one higher set temperature operating period corresponds to a respective one of the at least one heated water draw event determined at step 320. Conversely, each lower set temperature operating period of the at least one lower set temperature operating period corresponds to periods of time the at least one heated water draw event was not determined at step 320.

As an example, controller 150 can establish the future operating schedule for water heater appliance 100 with the following:

$$S(n) = \begin{cases} T_{high} & \text{if } n \in W \\ T_{low} & \text{otherwise} \end{cases}$$

where

S(n) is a set temperature of water heater appliance 100 at sample n, $T_{high}$ is a higher set temperature for water heater appliance 100, and $T_{low}$ is a lower set temperature for water heater appliance 100.

Figure 7:
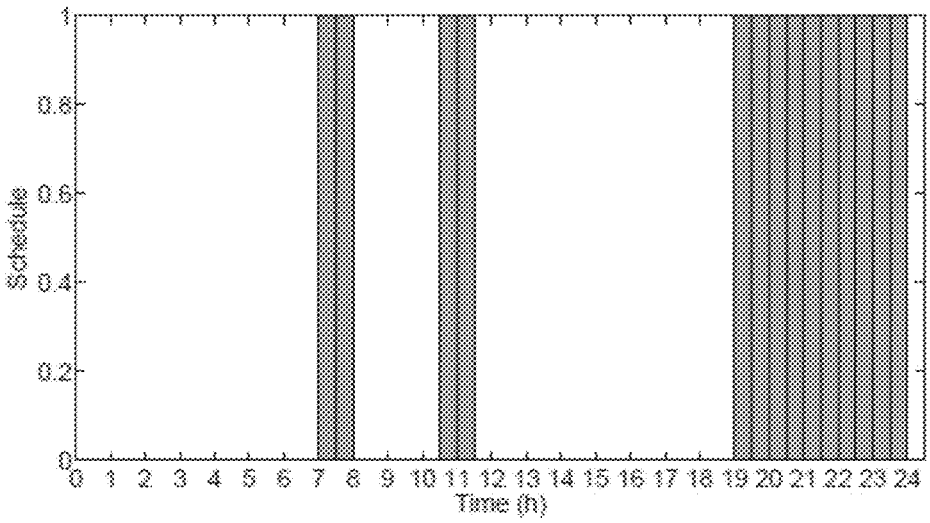
FIG. 7 illustrates an exemplary operating schedule for a water heater appliance as may be obtained with the present subject matter.

$T_{high}$ is greater than $T_{low}$. $T_{high}$ can be any suitable temperature, e.g., between about one-hundred degrees and one-hundred and forty degrees Fahrenheit. Similarly, $T_{low}$ can be any suitable temperature, e.g., between about forty degrees and one hundred degrees Fahrenheit. Utilizing the above process, controller 150 can establish the future operating schedule for water heater appliance 100. As an example, FIG. 7 illustrates an exemplary operating schedule for water heater appliance 100. During periods shown with bars, water heater appliance 100 operates at $T_{high}$. Conversely, water heater appliance 100 operates at $T_{low}$ during periods shown without bars. It should be understood that the future operating schedule can be determined using any other suitable mechanism or process in alternative exemplary embodiments. Thus, the process provided above is provided by way of example only and is not intended to limit the present subject matter in any aspect.

Method 300 can capture or identify a habit of a user of water heater appliance 100 and predict when the user will utilize heated water from water heater appliance 100 in the future. By predicting such heated water usage, water heater appliance 100 can operate at $T_{high}$ when the user consumes relatively large volumes of heated water, and water heater appliance 100 can operate at $T_{low}$ when the user consumes relatively small volumes of heated water.

By shifting the operating temperature of water heater appliance 100 between $T_{high}$ and $T_{low}$, a cost of operating water heater appliance 100 can be reduced and an efficiency of water heater appliance 100 can be improved as well. For example, operating water heater appliance 100 at $T_{high}$ can be more expensive and/or less efficient relative to $T_{low}$. Thus, operating water heater appliance 100 at $T_{low}$ during periods of relatively low heated water demand can assist with reducing the cost of operating water heater appliance 100 and increasing the efficiency of water heater appliance 100.

Method 300 can also include calculating a transition rate of water heater appliance 100 between $T_{low}$ and $T_{high}$. The transition rate of water heater appliance 100 corresponds to a rate at which heating element 105 heats water within water heater appliance 100. For example, heating element 105 of water heater appliance 100 has a certain power output and requires a particular period of time to heat water within water heater appliance 100 from $T_{low}$ to $T_{high}$. Controller 150 can calculate the transition rate of water heater appliance 100 with the following:

$$d = \frac{\sum_i \Delta t_i}{\sum_i \Delta T_i}$$

where d is the transition rate of water heater appliance 100, $\Delta t_i$ are time intervals when water within water heater appliance 100 is increasing in temperature, and $\Delta T_i$ are temperatures of water within water heater appliance 100 when water within water heater appliance 100 is increasing in temperature.

In such a manner, controller 150 can calculate the transition rate of water heater appliance 100 and, e.g., determine a time interval need for heating element 105 to heat water within water heater appliance 100 from $T_{low}$ to $T_{high}$. The transition rate can be calculated daily, e.g., in order to account for ambient condition changes and/or efficiency of heating element 105.

Method 300 can further include adjusting the future operating schedule of step 330 based at least in part upon the transition rate of water heater appliance 100. For example, controller 150 can adjust the future operating schedule such that water within water heater appliance 100 is preheated to $T_{high}$ at each transition between $T_{low}$ and $T_{high}$ in the future operating schedule. Thus, water at $T_{high}$ can be available when each higher set temperature operating period begins.

Figure 4:
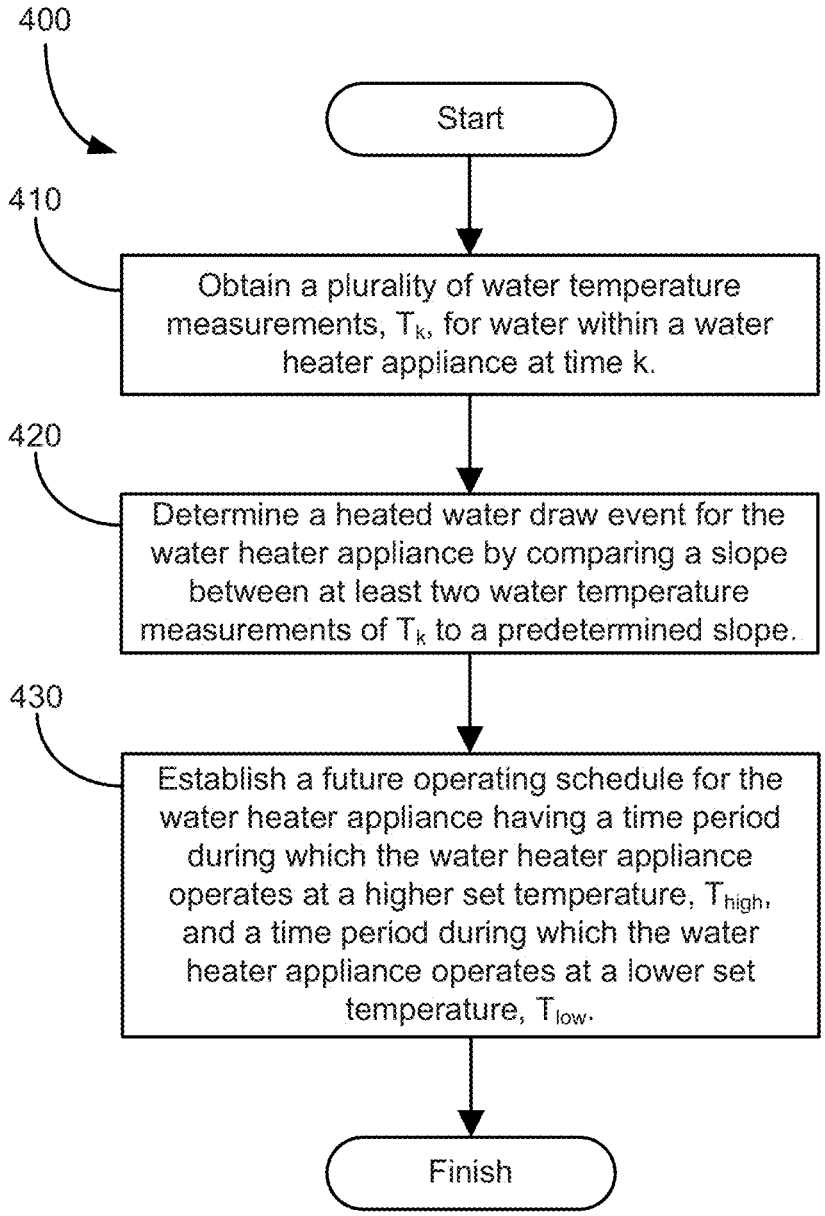
FIG. 4 provides a method for operating a water heater appliance according to an additional exemplary embodiment of the present subject matter.

FIG. 4 provides a method 400 for operating a water heater appliance, such as water heater appliance 100, according to an additional exemplary embodiment of the present subject matter. Method 400 can be implemented by controller 150 of water heater appliance 100. Method 400 can permit water heater appliance 100 to operate efficiently and in a more cost effective manner as discussed in greater detail below. Method 400 is substantially similar to method 300 and is described in context of the discussion of method 300 above.

At step 410, controller 150 obtains a plurality of water temperature measurements, $T_k$, for water within water heater appliance 100 at time k from temperature sensor 114. At step 420, controller 150 determines a heated water draw event or high volume heated water event for water heater appliance 100 by comparing a slope between at least two water temperature measurements of $T_k$ to a predetermined slope. At step 430, controller 150 establishes a future operating schedule for water heater appliance 100. The future operating schedule includes a time period during which water heater appliance 100 operates at a higher set temperature, $T_{high}$, and a time period during which water heater appliance 100 operates at a lower set temperature, $T_{low}$. The time period during which water heater appliance 100 operates at $T_{high}$ corresponds to the high volume heated water event of step 420.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a water heater appliance, comprising:

obtaining a plurality of water temperature measurements for water within the water heater appliance over a period of time;

determining at least one heated water draw event for the water heater appliance based at least in part upon the plurality of water temperature measurements;

establishing an operating schedule for the water heater appliance based at least in part upon the at least one heated water draw event; and controlling a heating element of the water heater appliance according to the operating schedule, wherein the at least one heated water draw event for the water heater appliance is determined with the following:

$$W = \left\{ n: \sum_{j=1}^{K} h_j(n) \geq \alpha K \right\}$$

-continued where $W$ is a set of samples $n$, $$h_j(n) = \begin{cases} 1 & \sum_{i=(n-1)N+1}^{nN} H_j(i) \geq N/2 \\ 0 & \text{otherwise} \end{cases},$$

$h_j(n)$ is a sampled heated water draw event value at sample n on day j,

N is a number of minutes between samples, $H_j(i)$ is a heated water draw event value at time i on day j that is one during heated water draw events and zero otherwise, K is a number of days, and $\alpha$ is a confidence factor.

2. The method of claim 1, wherein the operating schedule includes at least one higher set temperature operating period and at least one lower set temperature operating period, each higher set temperature operating period of the at least one higher set temperature operating period corresponding to a respective one of the at least one heated water draw event.

3. The method of claim 1, wherein said step of determining comprises determining the at least one heated water draw event for the water heater appliance by comparing a slope over time between at least two water temperature measurements of the plurality of water temperature measurements to a predetermined slope.

4. The method of claim 3, wherein each heated water draw event of the at least one heated water draw event corresponds to a portion of the period of time during which the magnitude of the slope between the at least two water temperature measurements is greater than the magnitude of the predetermined slope.

5. The method of claim 1, wherein said step of establishing comprises establishing the operating schedule for the water heater appliance with the following:

$$S(n) = \begin{cases} T_{high} & \text{if } n \in W \\ T_{low} & \text{otherwise} \end{cases}$$

where

S(n) is a set temperature of the water heater appliance at sample n, $T_{high}$ is a higher set temperature for water heater appliance, and $T_{low}$ is a lower set temperature for water heater appliance.

6. The method of claim 5, wherein $T_{high}$ is greater than $T_{low}$.

7. The method of claim 5, wherein at least one of $T_{high}$ and $T_{low}$ are selectable by a user of the water heater appliance.

8. The method of claim 1, further comprising calculating a transition rate of the water heater appliance between a lower set temperature, $T_{low}$, and a higher set temperature, $T_{high}$, the transition rate of water heater appliance corresponding to a rate at which the heating element heats the water within the water heater appliance from $T_{low}$ to $T_{high}$.

9. The method of claim 8, further comprising adjusting the operating schedule for the water heater appliance based at least in part upon the transition rate of the water heater appliance.

10. The method of claim 9, wherein said step of adjusting comprises adjusting the operating schedule for the water heater appliance such that water within the water heater appliance is preheated to $T_{high}$ at each transition between $T_{low}$ and $T_{high}$ in the operating schedule for the water heater appliance.

11. The method of claim 8, wherein the transition rate of the water heater appliance is calculated with the following:

$$d = \frac{\sum_i \Delta t_i}{\sum_i \Delta T_i}$$

where d is the transition rate of the water heater appliance, $\Delta t_i$ are time intervals when water within the water heater appliance is increasing in temperature, and $\Delta T_i$ are temperatures of water within the water heater appliance when water within the water heater appliance is increasing in temperature.

12. The method of claim 11, wherein d is calculated daily.

13. A method for operating a water heater appliance, comprising:

obtaining a plurality of water temperature measurements, $T_k$, for water within the water heater appliance at times k;

determining a high volume heated water event for the water heater appliance;

establishing an operating schedule for the water heater appliance, the operating schedule including a time period during which the water heater appliance operates at a higher set temperature, $T_{high}$, and a time period during which the water heater appliance operates at a lower set temperature, $T_{low}$, the time period during which the water heater appliance operates at $T_{high}$ corresponding to the high volume heated water event; and heating water within the water heater appliance to either $T_{high}$ or $T_{low}$ according to the operating schedule, wherein the high volume heated water event is determined with the following:

$$W = \left\{ n : \sum_{j=1}^{K} h_j(n) \geq \alpha K \right\}$$

where $W$ is a set of samples $n$, $$h_j(n) = \begin{cases} 1 & \text{if } \sum_{i=n(n-1)N+1}^{nN} H_j(i) \geq N/2 \\ 0 & \text{otherwise} \end{cases},$$

$h_j(n)$ is a sampled heated water draw event value at sample n on day j,

N is a number of minutes between samples, $H_j(i)$ is a heated water draw event value at time i on day j that is one during heated water draw events and zero otherwise, K is a number of days, and $\alpha$ is a confidence factor.

14. The appliance of claim 13, further comprising calculating a transition rate of the water heater appliance between $T_{low}$ and $T_{high}$, the transition rate of water heater appliance corresponding to a rate at which a heating element heats the water within the water heater appliance from $T_{low}$ to $T_{high}$.

15. The appliance of claim 14, further comprising adjusting the operating schedule for the water heater appliance based at least in part upon the transition rate of the water heater appliance.

16. The appliance of claim 15 wherein said step of adjusting comprises adjusting the operating schedule for the water heater appliance such that water within the water heater appliance is preheated to $T_{high}$ at the transition between the time period during which the water heater appliance operates at $T_{low}$ and the time period during which the water heater appliance operates at $T_{high}$ in the operating schedule for the water heater appliance.

17. The appliance of claim 13, wherein said step of calculating comprises calculating the transition rate of the water heater appliance between $T_{low}$ and $T_{high}$ daily.

* * * * *